US010078978B2

(12) United States Patent
Amino

(10) Patent No.: US 10,078,978 B2
(45) Date of Patent: Sep. 18, 2018

(54) IMAGE DATA COMPRESSION AND TRANSMISSION

(71) Applicant: SAMSUNG DISPLAY CO., LTD., Yongin-si, Gyeonggi-Do (KR)

(72) Inventor: Tadashi Amino, Cheonan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/073,862

(22) Filed: Mar. 18, 2016

(65) Prior Publication Data

US 2016/0322010 A1 Nov. 3, 2016

(30) Foreign Application Priority Data

Apr. 30, 2015 (KR) ..... 10-2015-0062070

(51) Int. Cl.
*G09G 3/20* (2006.01)

(52) U.S. Cl.
CPC ... *G09G 3/2092* (2013.01); *G09G 2310/0275* (2013.01); *G09G 2340/02* (2013.01); *G09G 2350/00* (2013.01); *G09G 2370/08* (2013.01); *G09G 2370/20* (2013.01)

(58) Field of Classification Search
CPC ... H04N 19/593; H04N 19/124; H04N 19/184
See application file for complete search history.

(56) References Cited

U.S. PATENT DOCUMENTS 5,850,207 A * 12/1998 Eglit ..... G06T 3/4007 345/671
2005/0226500 A1* 10/2005 Sasaki ..... H04N 11/046 382/166
2006/0164365 A1 7/2006 Huang et al.

FOREIGN PATENT DOCUMENTS

| | | |
|---|---|---|
| JP | 5240151 | 4/2013 |
| KR | 1020110041281 | 4/2011 |
| KR | 1020120052739 | 5/2012 |

* cited by examiner

*Primary Examiner* — Zhengxi Liu
*Assistant Examiner* — Raffi Isanians
(74) *Attorney, Agent, or Firm* — F. Chau & Associates, LLC

(57) ABSTRACT

A display device includes: a display panel including a plurality of pixels; a data compressor compressing first line data received from the outside to generate first compressed data, compressing differential data between the first line data and second line data, which are the previous line data of the first line data, to generate second compressed data, and selectively outputting any one of the first and second compressed data; and a source driver decompressing the compressed data output from the data compressor to reconstruct the first line data and supplying data signals corresponding to the reconstructed first line data to the plurality of pixels.

10 Claims, 7 Drawing Sheets

IMAGE DATA COMPRESSION AND TRANSMISSION

CROSS-REFERENCE TO RELATED APPLICATION

This application claims priority to and the benefit of Korean Patent Application No. 10-2015-0062070 filed in the Korean Intellectual Property Office on Apr. 30, 2015, the entire contents of which are incorporated by reference herein.

TECHNICAL FIELD

The present invention relates to compressing and transmitting image data to a display device.

DISCUSSION OF THE RELATED ART

Recently, liquid crystal display devices having a high resolution such as full high definition (FHD) (1902×1080), ultra high definition (UHD) (4840×2160), and the like, have been developed. When the resolution of the display device is increased, the amount of image data transmitted from the driver to the display panel is also increased. Therefore, to transmit the image data to the display panel within a preset time in a high-resolution display device, the speed of a source driver integrated chip (SD-IC) transferring the image data to the display panel needs to be increased. However, there is a limit in increasing the communication speed of the SD-IC. Additionally, as the resolution of the display device becomes higher, the number of SD-ICs is also increased, which increases the cost of the display device.

SUMMARY

An exemplary embodiment of the present invention provides a display device including multiple components.

The display device includes a display panel including a plurality of pixels.

The display device includes a data compressor compressing a received first line data to generate a first compressed data, determining a differential data between the first line data and a second line data, wherein the second line data is a prior first line data that has been compressed and decompressed, compressing the differential data to generate a second compressed data, and selectively outputting any one of the first and second compressed data.

A source driver integrated chip decompressing the compressed data output from the data compressor to reconstruct the first line data and supplying data signals corresponding to the reconstructed first line data to the plurality of pixels. The source driver decompresses the first compressed data to reconstruct the first line data, based upon receiving the first compressed data from the data compressor. Alternatively, the source driver sums up second line data reconstructed by the source driver and data generated by decompressing the second compressed data to reconstruct the first line data, based upon receiving the second compressed data from the data compressor.

According to an exemplary embodiment of the present invention, data is compressed and transmitted, such that the number of source driver integrated chips (SD-ICs) is decreased, making it possible to decrease a cost of a display device.

An exemplary embodiment of the present invention provides a display device including a display panel including a plurality of pixels.

The display device also includes a data compressor including multiple components. The data compressor includes a compression device that receives the first line data from an external system, receives a second line data from a line memory, compresses and outputs a plurality of compressed data. The data compressor includes a bit stream selector selecting one of the plurality of compressed data and outputting the selected compressed data. The data compressor includes a first decompression device receiving the selected compressed data, decompressing the compressed data and transmitting the decompressed data to the line memory. The data compressor includes a line memory to store the decompressed data as the second line data.

The display device also includes a source driver integrated chip including multiple components. The source driver integrated chip includes a second decompression device to receive the compressed data from the bit stream selector, receive second line data from a data arranging device, decompress and output a decompressed data. The source driver integrated chip includes a data arranging device to receive the decompressed data from the decompression unit and buffer the data to arrange and output the decompressed data. The source driver integrated chip includes a data output device to convert the received data into data signals in accordance with characteristics of the display panel and output the data signals.

DETAILED DESCRIPTION OF THE EMBODIMENTS

Figure 1:
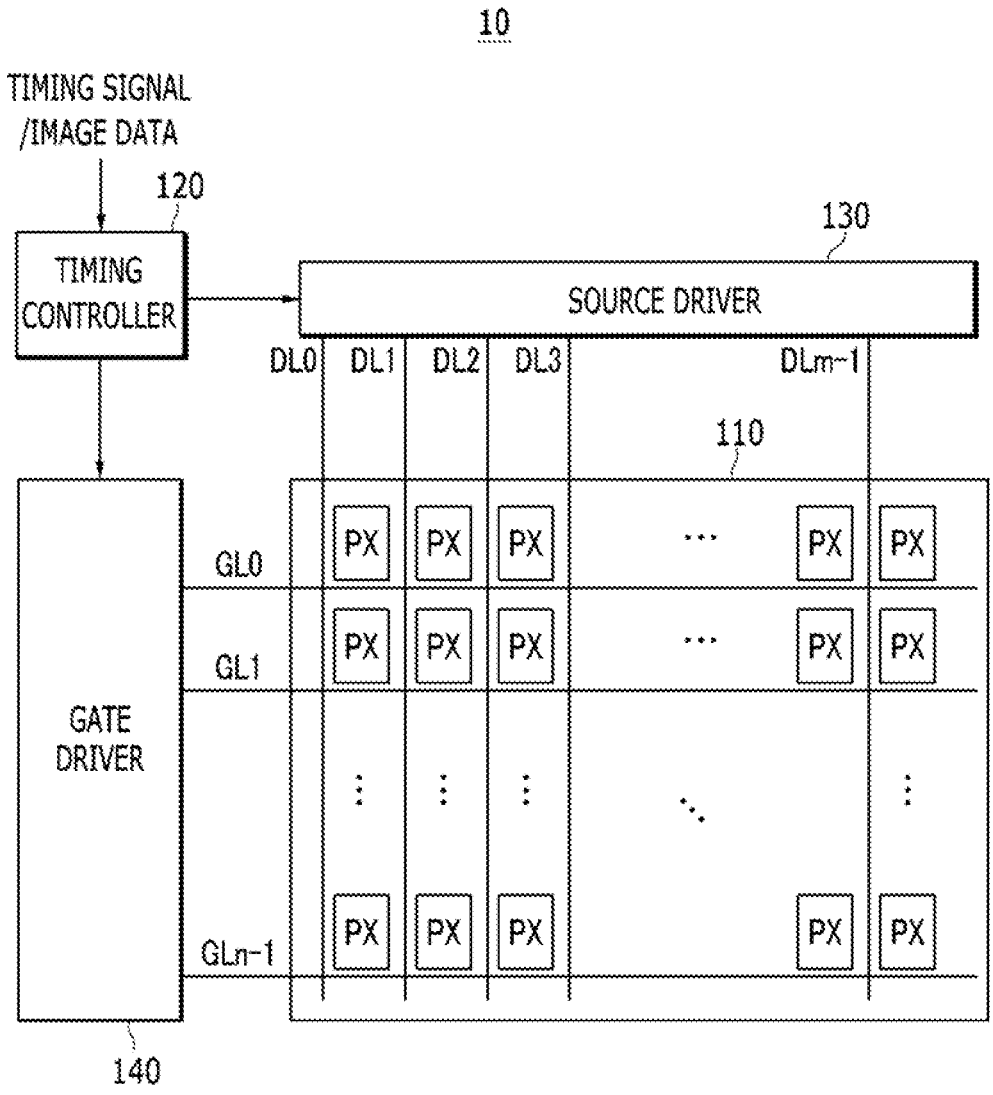
FIG. 1 is a schematic block diagram of a display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

The term "unit", as used herein, means, but is not limited to, a software or hardware component, such as a field programmable gate array (FPGA) or an application specific integrated circuit (ASIC), which performs certain tasks. A unit may advantageously be configured to reside in the addressable storage medium and configured to execute on one or more processors. Thus, a unit may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and units may be combined into fewer components and units or further separated into additional components and units.

In addition, throughout the present specification, unless explicitly described to the contrary, the word "comprise" and variations such as "comprises" or "comprising" will be understood to imply the inclusion of stated elements but not the exclusion of any other elements.

Hereinafter, a display device according to an exemplary embodiment of the present invention will be described in detail with reference to the accompanying drawings.

Figure 2:
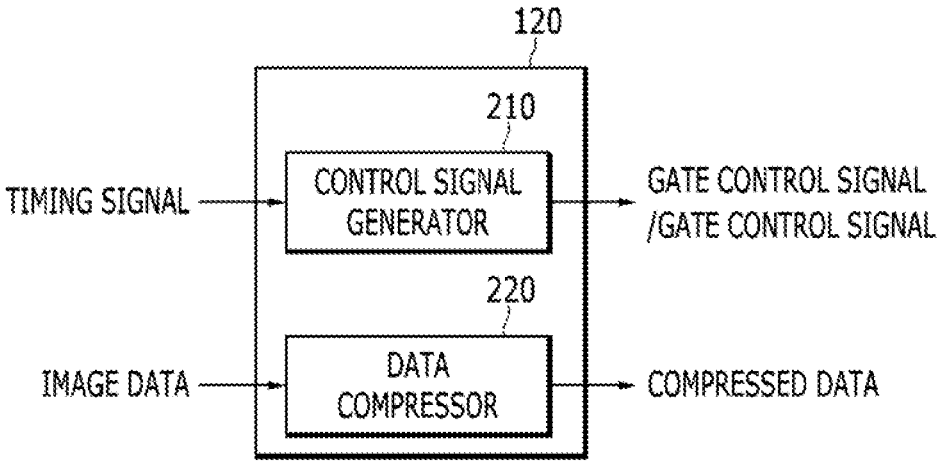
FIG. 2 is a schematic block diagram of a timing controller according to an exemplary embodiment of the present invention.
Figure 3:
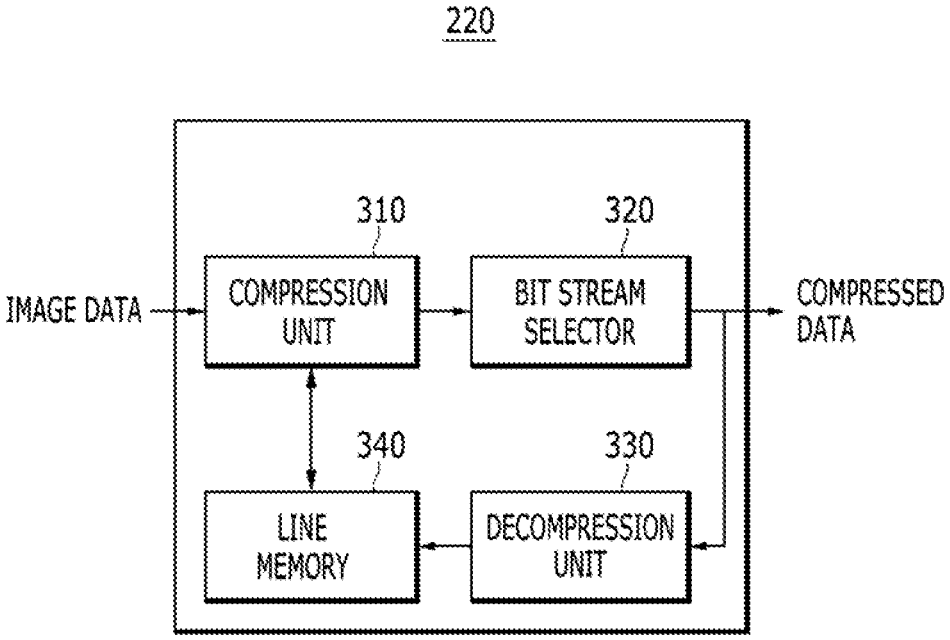
FIG. 3 is a schematic block diagram of a data compressor according to an exemplary embodiment of the present invention.
Figure 4:
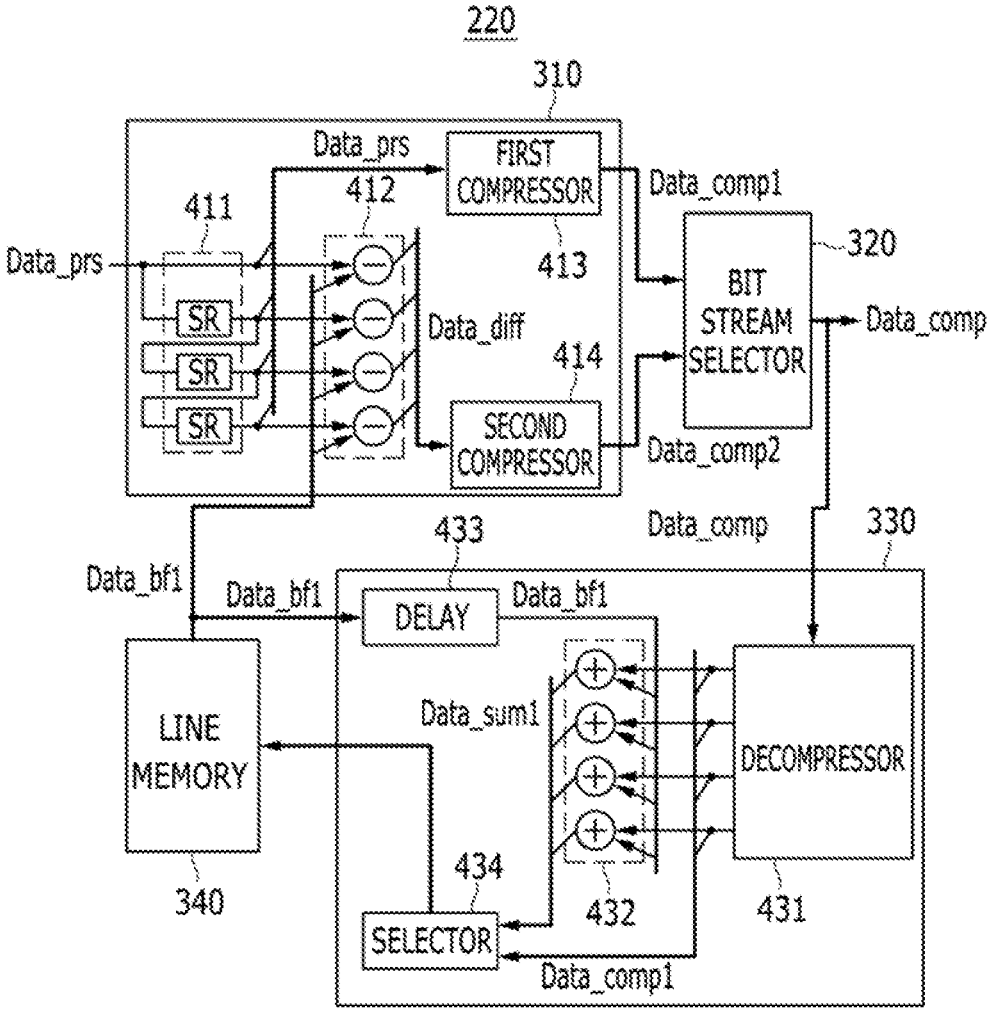
FIG. 4 is a detailed block diagram of the data compressor according to an exemplary embodiment of the present invention.
Figure 5:
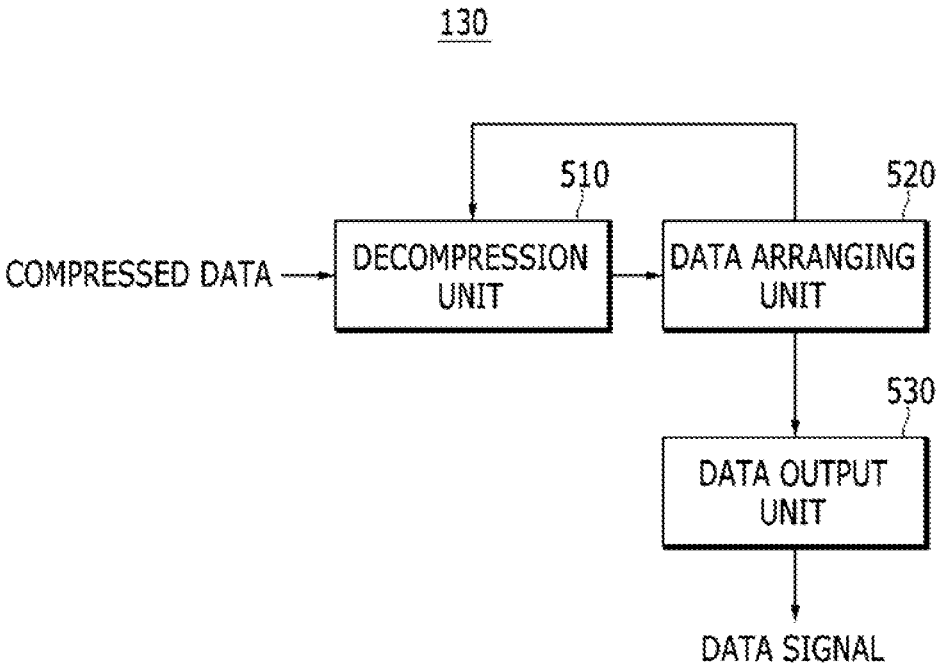
FIG. 5 is a schematic block diagram of a source driver integrated chip (SD-IC) according to an exemplary embodiment of the present invention.
Figure 6:
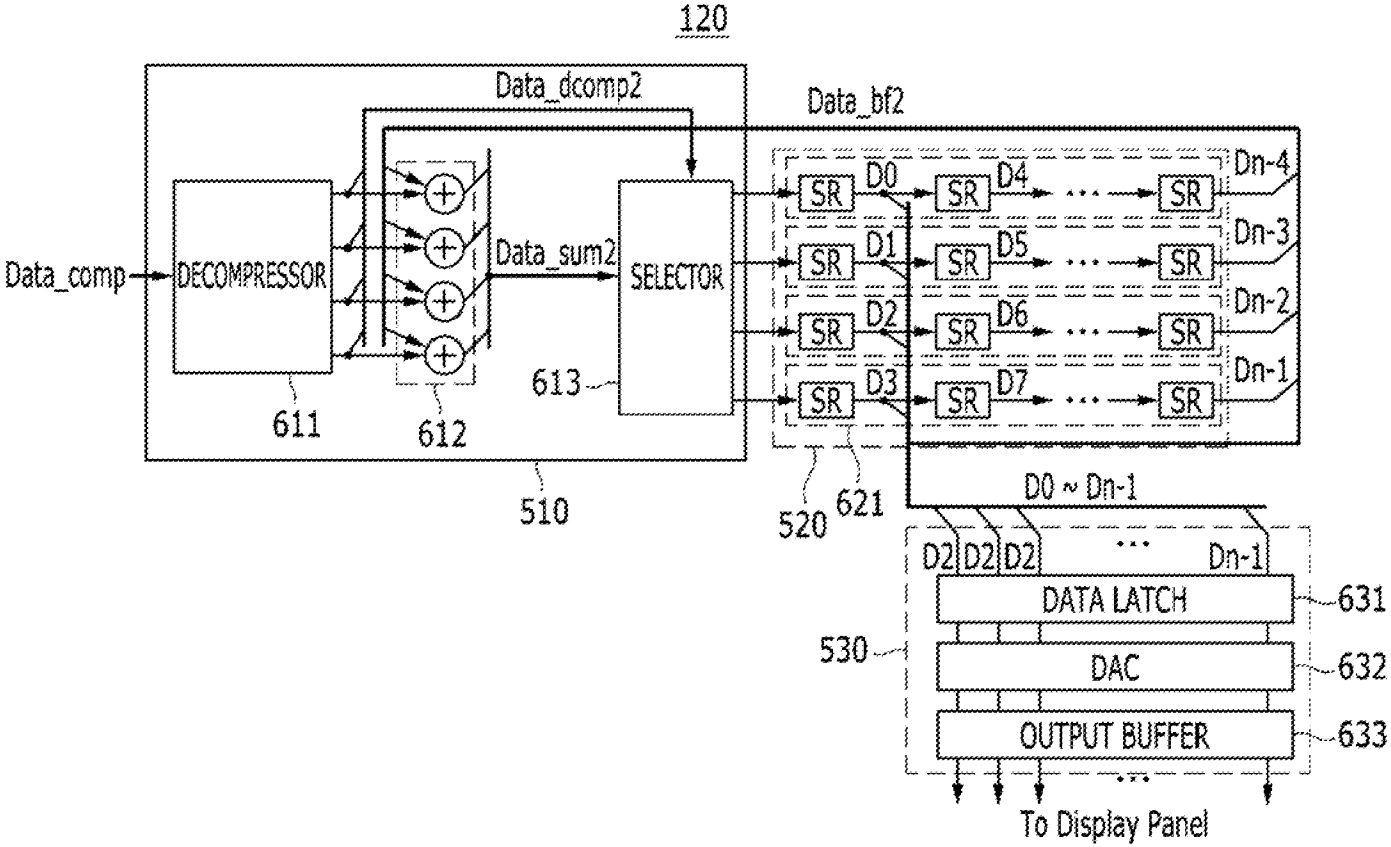
FIG. 6 is a detailed block diagram of the SD-IC according to an exemplary embodiment of the present invention.
Figure 7:
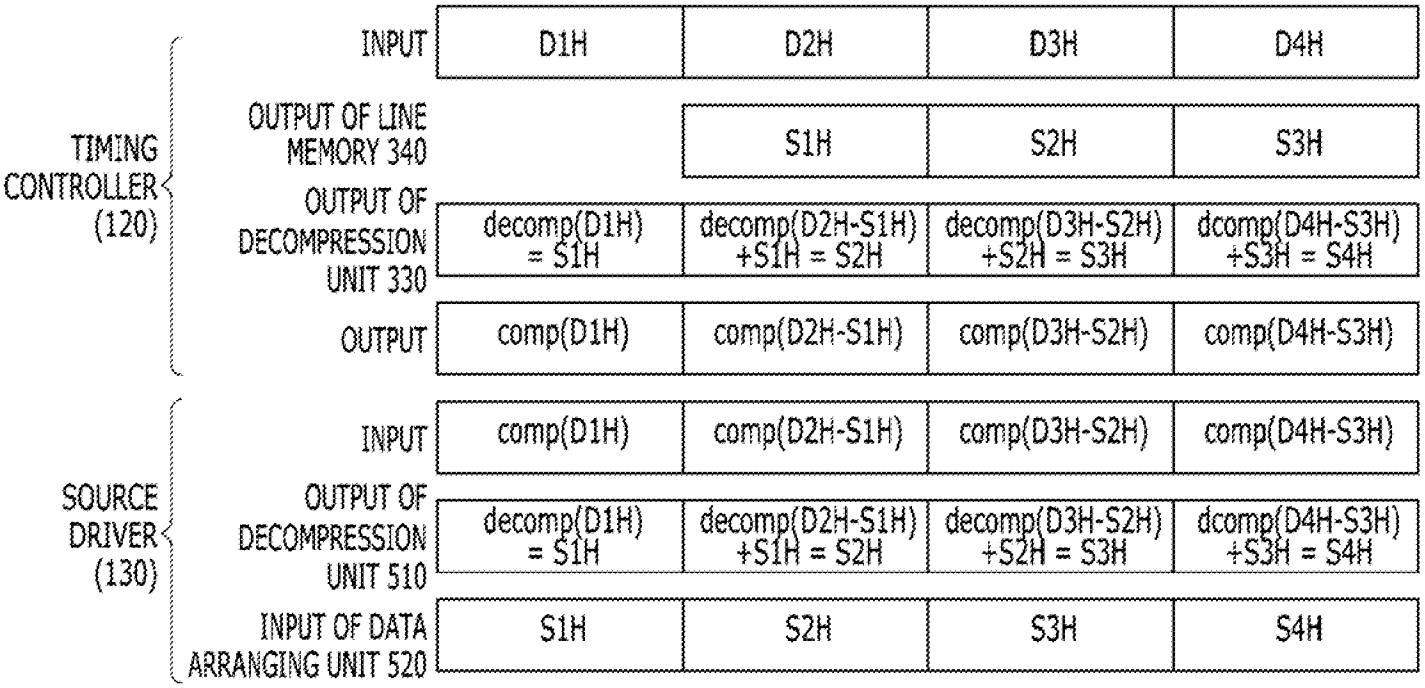
FIG. 7 is a schematic driving timing diagram of a timing controller and a source driver according to an exemplary embodiment of the present invention.

FIG. 1 is a schematic block diagram of a display device according to an exemplary embodiment of the present invention. FIG. 2 is a schematic block diagram of a timing controller according to an exemplary embodiment of the present invention. FIG. 3 is a schematic block diagram of a data compressor according to an exemplary embodiment of the present invention, and FIG. 4 is a detailed block diagram of the data compressor according to an exemplary embodiment of the present invention. FIG. 5 is a schematic block diagram of a source driver integrated chip (SD-IC) according to an exemplary embodiment of the present invention, and FIG. 6 is a detailed block diagram of the SD-IC according to an exemplary embodiment of the present invention. FIG. 7 is a schematic driving timing diagram of a timing controller and a source driver according to an exemplary embodiment of the present invention.

Referring to FIG. 1, the display device 10 according to an exemplary embodiment of the present invention may include a display panel 110, a timing controller 120, a source driver 130, a gate driver 140, and the like.

The display panel 110 includes a plurality of pixels PXs formed per pixel area defined by intersection between a plurality of gate lines GL0 to GLn−1 and a plurality of data lines DL0 to DLm−1.

The timing controller 120 generates control signals for controlling the source driver 130 and the gate driver 140 using timing signals input from an external system. In addition, the timing controller 120 receives image data from the external system and transfers the image data to the source driver 130.

Referring to FIG. 2, the timing controller 120 may include a control signal generator 210 and a data compressor 220.

The control signal generator 210 receives timing signals required for generating control signals such as a vertical synchronization signal, a horizontal synchronization signal Hsync, a data enable signal DE, and the like, from the external system. The control signal generator 210 generates a data control signal for controlling operation timing of the source driver 130 and a gate control signal for controlling operation timing of the gate driver 140 using the received timing signals. The vertical synchronization signal is a signal for distinguishing the respective frames from each other, and the horizontal synchronization signal is a signal for distinguishing the respective horizontal lines configuring the frames from each other. One frame time for the image data corresponds to a vertical period by the vertical synchronization signal and a plurality of horizontal periods are repeated in one vertical period.

The data compressor 220 may compress the image data and transfer the compressed image data to the source driver 130 to increase a data transmission speed at the time of transmitting the image data to the source driver 130. The data compressor 220 compresses the data through a line correlation in a vertical direction. For example, the data compressor 220 generates compressed data through a line correlation between the present line data and the previous line data when the image data is received. Meanwhile, although the case in which the data compressor 220 is a component of the timing controller 120 has been shown by way of example in FIG. 2, an exemplary embodiment of the present invention is not limited thereto. The data compressor 220 may also be implemented as a component separate from the timing controller 120.

Referring to FIG. 3, the data compressor 220 according to an exemplary embodiment of the present invention may include a compression unit, 310, a bit stream selector, 320, a decompression unit 330, a line memory 340, and the like.

The compression unit 310 compresses the present line data to generate a first compressed data, when the image data is received from the external system. In addition, the compression unit 310 reads the previous line data from the line memory 340 and compresses a differential between the present line data and the previous line data to obtain a second compressed data. The line data is a data group in a unit of a pixel row, and this data group may be output to the display panel 110 in one horizontal period. The image data is then divided into a plurality of line data and is then received. The line data may be divided into the present line data and the previous line data based on a point in time in which they are received in the timing controller 120.

Meanwhile, the compression unit 310 may receive substantially all of a unit of line data corresponding to one pixel row at a time or sequentially receive the substantially all of a unit of line data divided into a plurality of data groups. For example, the compression unit 310 may receive the line data corresponding to one pixel row in a unit of four continuous pixels. In the case in which the compression unit 310 sequentially receives the line data divided into a plurality of data groups, the compression unit 310 may generate the first and second compressed data in a unit of the received data group.

The compression unit 310 may generate the first and second compressed data in a scheme of compressing differential pulse code modulation (DPCM) data in a variable length code. A differential pulse code modulation scheme is a modulation scheme for extracting differential information between the previous data and the present data. In addition, the variable length code is a compression scheme for allocating a short number of bits to a data value having a high frequency and allocating a long number of bits to a data value having a low frequency. For example, the number of bits of 1 may be allocated to '0' having a high frequency, and the number of bits of 9 may be applied to data values other than '0'.

Next, a compression scheme of the compression unit 310 will be described in detail with reference to Tables 1A to 2B.

Table 1A shows an example of line data, and Table 1B shows a compression result of the line data of Table 1A by the compression unit 310.

TABLE 1A

| Example of Line Data | | | | |
|---|---|---|---|---|
| Previous Line Data | 0 | 25 | 52 | 85 |
| Present Line Data | 0 | 25 | 52 | 85 |

TABLE 1B

| Example of Compressed Data | | | | | | |
|---|---|---|---|---|---|---|
| Compressed Data | | | | | | Total |
| First Compressed Data | DPCM Data | 0 | 25 | 27 | 33 | |
| | Number of Bits | 1 | 9 | 9 | 9 | 28 bits |
| Second Compressed Data | DPCM Data | 0 | 0 | 0 | 0 | |
| | Number of Bits | 1 | 1 | 1 | 1 | 4 bits |

Referring to Table 1A, in the case in which the compression unit 310 compresses the present line data of which pixel values are '0', '25', '52', and '85', respectively, it allocates the numbers of bits of 1, 9, 9, and 9 to the respective pixel values, respectively. Therefore, the number of bits of 28 is allocated to the first compressed data generated by compressing the present line data. In addition, in the case in which the compression unit 310 compresses differentials '0', '0', '0', and '0' of pixel values between the present line data and the previous line data, it allocates the numbers of bits of 1, 1, 1, and 1 to the differentials, respectively. Therefore, the number of bits of 4 is allocated to the second compressed data generated by compressing differentials between the present line data and the previous line data.

Table 2A shows another example of line data, and Table 2B shows a compression result of the line data of Table 2A by the compression unit 310.

TABLE 2A

| Another Example of Line Data | | | | |
|---|---|---|---|---|
| Previous Line Data | 85 | 52 | 25 | 22 |
| Present Line Data | 90 | 90 | 90 | 90 |

TABLE 2B

| Another Example of Compressed Data | | | | | | |
|---|---|---|---|---|---|---|
| Compressed Data | | | | | | Total |
| First Compressed Data | DPCM Data | 90 | 0 | 0 | 0 | |
| | Number of Bits | 9 | 1 | 1 | 1 | 12 bits |
| Second Compressed Data | DPCM Data | 5 | 33 | 27 | 3 | |
| | Number of Bits | 9 | 9 | 9 | 9 | 36 bits |

Referring to Tables 2A and 2B, in the case in which the compression unit 310 compresses the present line data of which pixel values are '90', '0', '0', and '0', respectively, it allocates the numbers of bits of 9, 1, 1, and 1 to the respective pixel values, respectively. Therefore, the number of bits of 12 is allocated to the first compressed data generated by compressing the present line data. In addition, in the case in which the compression unit 310 compresses differentials '5', '33', '27', and '3' of pixel values between the present line data and the previous line data, it allocates the numbers of bits of 9, 9, 9, and 9 to the differentials, respectively. Therefore, the number of bits of 36 is allocated to the second compressed data generated by compressing differentials between the present line data and the previous line data.

As described with reference to Tables 1A to 2B, it may be appreciated that in the case of using a scheme of compressing the DPCM data in the variable length code, as a correlation between the previous line data and the present line data becomes high, compression efficiency for the differentials between the two line data is increased. As shown in Table 1A, in the case in which the two line data are substantially the same as each other, the smaller numbers of bits are allocated to the compressed data on the differentials between the two line data than to the compressed data of the present line data. On the other hand, as shown in Table 2A, in the case in which a correlation between the two line data is low, the larger numbers of bits are allocated to the compressed data on the differentials between the two line data than to the compressed data of the present line data.

Again referring to FIG. 3, the bit string selector 320 selects any one of the first and second compressed data output from the compression unit 310 and outputs the selected compressed data. For example, the bit stream selector 320 compares the first and second compressed data with each other, selects compressed data having a smaller amount of data (number of bits), and outputs the selected compressed data as a transmission bit stream. When the bit stream selector 320 outputs the selected compressed data, it may add an identification flag indicating whether the selected compressed data is the first compressed data or the second compressed data to the selected compressed data and then outputs the selected compressed data to which the identification flag is added. For example, in the case in which the bit stream selector 320 selects and outputs the first compressed data, it adds an identification flag '0' to the first compressed data and then outputs the first compressed data to which the identification flag '0' is added, and in the case in which the bit stream selector 320 selects and outputs the second compressed data, it adds an identification flag '1' to the second compressed data and then outputs the second compressed data to which the identification flag '1' is added.

The compressed data selected by the bit stream selector 320 is output to both the decompression unit 330 and the source driver 130.

The decompression unit 330 decompresses the compressed data output from the bit stream selector 320. In the case in which the compressed data selected by the bit stream selector 320 is the first compressed data generated by compressing the present line data, the decompression unit 330 stores data generated by decompressing the compressed data, in other words, the present line data is stored in the line memory 340. On the other hand, in the case in which the compressed data selected by the bit stream selector 320 is the second compressed data generated by compressing the differentials between the present line data and the previous line data, the decompression unit 330 decompresses the compressed data and then sums up the decompressed data and the previous line data stored in the line memory 340. In addition, a result obtained by summing up the decompressed data and the previous line data is stored as the present line data in the line memory 340.

The present line data stored in the line memory 340 may be used as the previous line data of the next line data when the next line data is subsequently input.

In an exemplary embodiment of the present invention, the compression unit 310 performs differential calculation and compression in a pixel unit. For example, when line data corresponding to a plurality of pixel groups are input from the external system, the compression unit 310 may arrange the line data in the pixel unit and perform the differential calculation and the compression. In addition, the decompression unit 330 performs decompression and differential summing-up in the pixel unit to decompress the present line data from the compressed data compressed by the compression unit 310.

Next, an operation of the data compressor 220 will be described in detail with reference to FIG. 4.

Referring to FIG. 4, the compression unit 310 may include a data arranging unit 411, a differential unit 412, first and second compressors 413 and 414, and the like.

The data arranging unit 411 arranges present line data Data_prs in a pixel unit when the present line data Data_prs is received in a pixel unit of a plurality of pixel groups from the external system. The data arranging unit 411 includes a plurality of shift registers SRs dependently connected to each other, and divides and outputs input data Data_prs in the pixel unit using the plurality of shift registers SRs. For example, when the line data is received in a unit of four pixel groups, the data arranging unit 411 may divide and output the line data for each of four pixels. The present line data Data_prs arranged in the pixel unit by the data arranging unit 411 are outputs of the differential unit 412 and the first compressor 413.

The differential unit 412 calculates differentials between the present line data Data_prs divided and output in the pixel unit from the data arranging unit 411 and the previous line data Data_bf1 in the pixel unit. For example, the differential unit 412 calculates differential data Data_diff between the respective pixel data included in the present line data Data_prs and the respective pixel data included in the previous line data Data_bf1. The previous line data DATA_bf1 used for calculating the differentials are obtained from the line memory 340. The differential data Data_diff between the present line data Data_prs and the previous line data Data_bf1 calculated by the differential unit 412 are output to the second compressor 414.

The first compressor 413 receives the present line data Data_prs from the data arranging unit 411 and outputs first compressed data Data_comp1 generated by compressing the present line data Data_prs.

The second compressor 414 receives the differential data Data_diff between the present line data Data_prs and the previous line data Data_bf1 from the differential unit 412 and outputs second compressed data Data_comp2 generated by compressing the differential data.

The first and second compressed data Data_comp1 and Data_comp2 generated by the first and second compressor 413 and 414 are output to the bit stream selector 320.

The bit stream selector 320 selects compressed data having a smaller amount of data as represented by the smaller number of bits through comparison between the first and second compressed data Data_comp1 and Data_comp2 when the first and second compressed data Data_comp1 and Data_comp2 are input. The compressed data Data_comp selected by the bit stream selector 320 are output to the decompression unit 330 and the source driver 130. Additionally, when the bit stream selector 320 transfers the selected compressed data to the source driver 130, it may add an identification flag. The identification flag indicates whether the corresponding data is generated by compressing the present line data Data_prs or data generated by compressing the differentials between the present line data and the previous line data. The identification flay may be used to select compressed data and transfer the selected compressed data.

The decompression unit 330 may include a decompressor 431, a summer 432, a delay 433, a selector 434, and the like.

The decompressor 431 decompresses and outputs the compressed data Data_comp output from the bit stream selector 320. The data Data_dcomp1 decompressed by the decompressor 431 are output to the summer 432 and the selector 434.

The summer 432 sums up and outputs the data Data_sum1 by summing up Data_dcomp1 decompressed by the decompressor 431 and the previous line data Data_bf1 in the pixel unit. The previous line data Data_bf1 is obtained from the line memory 340, and is delayed for a predetermined time by the delay 433 and is then input to the summer 432. To calculate the differentials between the previous line data Data_bf1 and the present line data Data_prs, the previous line data Data_bf1 output from the line memory 340 is output to each of the differential unit 412 of the compression unit 310 and the delay 433 of the decompression unit 330. The delay 433 delays and outputs the previous line data Data_bf1 from a point in time in which the previous line data Data_bf1 is input from the line memory 340 up to a point in time in which the data Data_dcomp1 decompressed by the decompressor 431 are input to the summer 432. Therefore, the summer 432 receives the previous line data Data_bf1 in accordance with a point in time in which the decompressed data Data_dcomp1 are received from the decompressor 431, making it possible to sum up and output the two data Data_dcomp1 and Data_bf.

The selector 434 receives the data Data_dcomp1 decompressed by the decompressor 431 and data Data_sum1 summed up by the summer 432. The selector 434 selects one of the data Data_dcomp1 and the data Data_sum depending on a selection result of the bit stream selector 320. The selector 434 stores the selected data in the line memory 340. In the case in which the compressed data Data_comp selected by the bit stream selector 320 is the data generated by compressing the present line data Data_prs, the selector 434 selects the data Data_dcomp1 decompressed by the decompressor 431 as the present line data Data_prs and stores the selected data in the line memory 340. In the case in which the compressed data Data_comp selected by the bit stream selector 320 is the data generated by compressing the differentials between the present line data Data_prs and the previous line data Data_bf1, the selector 434 selects the data Data_sum1 generated by summing up the previous line data Data_bf1 and the decompressed data Data_dcomp1 by the summer 432 as Data_sum1. The selector 434 stores the selected data in the line memory 340

Therefore, the previous line data stored in the line memory 340 may be updated with Data_sum1 reconstructed from the compressed data output from the bit stream selector 320 and be used to calculate differentials with the next line data.

Again referring to FIG. 1, the source driver 130 receives data control signals such as a data enable signal, a horizontal start signal, and the like, from the timing controller 120. The data enable signal is a signal for identifying an active section in which data signals are substantially output to the display panel 110. The source driver 130 supplies the data signals to the data lines DL0 to DLm−1 in synchronization with the data control signals. The source driver 130 supplies data signals corresponding to one horizontal line to the data lines DL0 to DLm−1 per one horizontal period in which scan signals are supplied to the respective gate lines GL0 to GLn−1. For example, the source driver 130 supplies a plurality of data signals to pixel rows correspond to the supplied scan signals in accordance with scan signal supply timing of each horizontal line.

When compressed image data is received from the timing controller 120, the source driver 130 decompresses the compressed image data to reconstruct the image data. In addition, the source driver 130 converts the reconstructed image data into data signals in accordance with characteristics of the display panel 110 and then outputs the data signals to the respective data lines DL0 to DLm−1 of the display panel 110.

Referring to FIG. 5, the source driver 130 may include a decompression unit 510, a data arranging unit 520, a data output unit 530, and the like.

The decompression unit 510 is connected to the bit stream selector 320 of the timing controller 120, and receives the compressed data from the bit stream selector 320. The decompression unit 510 decompresses the compressed data input from the bit stream selector 320 to generate first decompressed data. In addition, the decompression unit 510 sums up data by decompressing the compressed data received from the bit stream selector 320 and the previous line data to generate second decompressed data. The previous line data is obtained from the data arranging unit 520.

The decompression unit 510 confirms an identification flag included in the compressed data received from the bit stream selector 320. In addition, the decompression unit 510 selects and outputs any one of the first and second decompressed data as the present line data based on the identification flag. Where the identification flag indicates that the compressed data received from the bit stream selector 320 is data generated by compressing the present line data, the decompression unit 510 selects the first decompressed data generated by decompressing the compressed data as the present line data. On the other hand, where the identification flag indicates that the compressed data received from the bit stream selector 320 is data generated by compressing differentials between the present line data and the previous line data, the decompression unit 510 selects the second decompressed data generated by summing up the data generated by decompressing the compressed data and the previous line data as the present line data. The decompressed data selected by the decompression unit 510 are output to the data arranging unit 520.

The data arranging unit 520 buffers the data output from the decompression unit 510 to arrange and output the data in a unit of one line. Each unit of one line corresponds to one pixel row. For example, the data arranging unit 520 receives the data in a unit of a plurality of pixel groups from the decompression unit 510 and buffers the data to arrange and output the data in a unit of the pixel row.

The data output unit 530 receives the data arranged in the unit of the pixel row from the data arranging unit 520. In addition, the data output unit 530 converts the received data into data signals in accordance with characteristics of the display panel 110 and then outputs the data signals to the respective data lines DL0 to DLm−1 of the display panel 110 depending on the data control signal.

Next, an operation of the source driver 130 according to an exemplary embodiment of the present invention will be described in detail with reference to FIG. 6.

Referring to FIG. 6, the decompression unit 510 includes a decompressor 611, a summer 612, and the like.

The decompressor 611 receives the compressed data Data_comp from the timing controller 120. The decompressor 611 decompresses the Data_comp and outputs the Data_dcomp2. The data Data_dcomp2 decompressed by the decompressor 611 is transmitted to the summer 612 and the selector 613.

The summer 612 sums up and outputs the data Data_dcomp2 decompressed by the decompressor 611 and the previous line data Data_bf2 in the pixel unit. The previous line data Data_bf2 used for the summing-up are obtained from the data arranging unit 520. Data Data_sum2 summed up by the summer 612 are output to the selector 613.

The selector 613 receives the data Data_dcomp2 decompressed by the decompressor 611 and the data Data_sum2 summed up by the summer 612, selects one of the data Data_dcomp2 and the data Data_sum2, and outputs the selected data to the data arranging unit 520. In the case in which the compressed data Data_comp received from the timing controller 120 is data generated by compressing the present line data, the selector 613 selects the data Data_dcomp2 decompressed by the decompressor 611 as the present line data and outputs the selected data to the data arranging unit 520. In the case in which the compressed data Data_comp input from the timing controller 120 is data generated by compressing differentials between the present line data and the previous line data, the selector 613 selects data Data_sum2 generated by summing up the previous line data Data_bf2 and the decompressed data Data_decomp2 by the summer 612 as the present line data and outputs the selected data to the data arranging unit 520.

The data arranging unit 520 includes a plurality of shift register groups 621. Each of the shift register groups 621 corresponds to each of a plurality of pixel data output from the data arranging unit 520. The line data is divided and transmitted in a unit of four pixels from the timing controller 120. The first and second decompressed data decompressed by the decompression unit 510 becomes a plurality of pixel data groups including pixel data on the four pixels. The decompression unit 510 selects one of the first and second decompressed data and divides and outputs the selected decompressed data for each pixel. The pixel data divided and output for each pixel by the decompression unit 510 are input to corresponding shift register groups 621.

The respective shift register groups 621 include a plurality of shift registers SRs. The shift register groups are sequentially shift-driven to arrange and output data output from the decompression unit 510 in a unit of a pixel row whenever new data is output from the decompression unit 510.

Shift resistors positioned at start stages of the respective shift resistor groups 621 have input terminals connected to an output terminal of the selector 613. Therefore, the plurality of shift register groups 621 are sequentially shift-driven whenever a new pixel data group is output from the selector 613. When a final pixel data group of the present line data is input to the plurality of shift register groups 621, data arranged in the unit of the pixel row by the shift registers SRs is output to the data output unit 530. In addition, shift registers positioned at final stages of the respective shift register groups 621 have output terminals connected to an input terminal of the summer 612. Therefore, after arrangement of the pixel data for the present line is completed, the shift resistors SRs are shift-driven making it possible to output the present line data as the previous line data of the next line data to the summer 612.

As described above, the source driver 130 may sequentially output the previous line data to the summer 612 by sequentially shift-driving the shift registers SRs when line data of a new line starts to be input from the data compressor 220.

The data output unit 530 may include a data latch 631, a digital to analog converter (DAC) 632, an output buffer 633, and the like.

The data latch 631 outputs line data output from the data arranging unit 520 to the digital to analog converter 632 when the arrangement of the pixel data corresponding to one line is finished by the data arranging unit 520.

The digital to analog converter 632 converts digital data output from the data latch 631 into analog signals appropriate for characteristics of the display panel 110 and outputs the converted analog signals.

The output buffer 633 outputs the data signal output from the digital to analog converter 632 to the respective data lines DL0 to DLm−1 of the display panel 110 depending on the data control signal of the timing controller 120.

Again referring to FIG. 1, the gate driver 140 receives the gate control signals from the timing controller 120. The gate driver 140 sequentially supplies the scan signals to the respective gate lines GL0 to GLn−1 based on the gate control signals.

As described above, the timing controller 120 includes the decompression unit 330 decompressing the compressed data output from the bit stream selector 320 in the same scheme as that of the decompression unit 510 included in the source driver 130. Therefore, the first decompressed data Data_dcomp1 and the second decompressed data Data_sum1 output from the decompression unit 330 of the timing controller 120 become the same data as the first decompressed data Data_dcomp2 and the second decompressed data Data_sum2 output from the decompression unit 510 of the source driver 130.

Referring to FIG. 7, in the case in which the timing controller 120 outputs compressed data generated by compressing differentials between the present line data and the previous line data. The decompression unit 330 of the timing controller 120 stores the present line data S1H, S2H, S3H, and S4H reconstructed by summing up differential data decomp (D1H), decomp (D2H-S1H), decomp (D3H-S2H), and decomp (D4H-S3H). The differential data is generated by decompressing compressed data comp (D1H), comp (D2H-S1H), comp (D3H-S2H), and comp (D4H-S3H) and the previous line data S1H, S2H, S3H, and SH4 in the line memory 340. The present line data S1H, S2H, S3H, and S4H stored in the line memory 340 is subsequently used as the previous line data of the next line data.

Meanwhile, in the case in which the decompression unit 510 of the source driver 130 receives compressed data comp (D1H), comp (D2H-S1H), comp (D3H-S2H), and comp (D4H-S3H) for differential data between the present line data and the previous line data from the timing controller 120. The timing controller 120 outputs the present line data S1H, S2H, S3H, and S4H reconstructed by summing up differential data decomp (D1H), decomp (D2H-S1H), decomp (D3H-S2H), and decomp (D4H-S3H) generated by decompressing the compressed data comp (D1H), comp (D2H-S1H), comp (D3H-S2H), and comp (D4H-S3H) and the previous line data S1H, S2H, and S3H. The present line data S1H, S2H, S3H, and S4H reconstructed as described above are input to the shift registers SRs of the data arranging unit 520 and are subsequently used as the previous line data of the next line data.

Generally, compressing and then decompressing data may introduce an error. In an embodiment of the invention the previous line data is acquired by decompressing the former present line data. In the process of calculating the differential between the present line data and the previous line data that is uncompressed in the timing controller 120 an error due to decompression may accumulate in the source driver 130. Therefore, in an exemplary embodiment of the present invention the decompression unit 330 is included in the timing controller 120 to obtain the previous line data for calculating the differentials in substantially the same scheme as that of the source driver 130. This change to the timing controller 120 makes it possible to prevent the accumulation of the error.

Since an analog signal of 10V or more is generally the input or output to the source driver 130, the source driver 130 is implemented using analog wirings having a large line width, which may withstand higher voltage than that of wirings for a digital signal. Therefore, due to a spatial limitation, it is difficult to perform a complicated compression process in a block unit, which requires a large amount of memory. In an exemplary embodiment of the present invention, the data is compressed through the line data correlation in the vertical direction, making it possible to implement a compression process without adding a separate line memory.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a display panel including a plurality of pixels; a data compressor compressing a received present line data to generate a first compressed data, determining a differential data between the present line data and a previous line data, wherein the previous line data is a line data that has been compressed and then decompressed by the data compressor, compressing the differential data to generate a second compressed data, and selectively outputting one of the first and second compressed data; and a source driver integrated chip decompressing the compressed data output from the data compressor to reconstruct the present line data and supplying data signals corresponding to the reconstructed present line data to the plurality of pixels, wherein the source driver decompresses the first compressed data to reconstruct the present line data, based upon receiving the first compressed data from the data compressor, otherwise the source driver sums up the previous line data reconstructed by the source driver and data generated by decompressing the second compressed data to reconstruct the present line data, based upon receiving the second compressed data from the data compressor, wherein the data compressor decompresses compressed data previously output from the data compressor to obtain the previous line data, wherein the data compressor includes: a line memory storing the previous line data therein; a compression unit compressing the present line data to be the first compressed data and compressing differential data between the previous line data read from the line memory and the present line data to be the second compressed data: a bit stream selector selectively outputting any one of the first and second compressed data output from the compression unit as the compressed data; and a first decompression unit reconstructing the present line data from the compressed data output from the bit stream selector and storing the reconstructed present line data in the line memory, wherein the source driver includes: a second decompression unit selectively outputting any one of first decompressed data generated by decompressing the compressed data received from the data compressor and second decompressed data generated by summing up the first decompressed data and the previous line data reconstructed by the source driver; a data arranging unit arranging and outputting the data output from the second decompression unit in a unit of a pixel row; and a data output unit converting the data output from the data arranging unit into the data signals in accordance with characteristics of the display panel and supplying the data signals to the plurality of pixels, wherein the bit stream selector adds an identification flag to the compressed data selected in the first and second compressed data and outputs the compressed data to which the identification flag is added, and wherein the second decompression unit selects any one of the first and second decompressed data based on the identification flag.

2. The display device of claim 1, wherein:

the bit steam selector selects compressed data having a smaller number of bits in the first and second compressed data and outputs the selected compressed data to the source driver.

3. The display device of claim 1, wherein:

the first decompression unit decompresses the first compressed data to reconstruct the present line data, when the first compressed data is output from the bit stream selector, and sums up the data generated by decompressing the second compressed data and the previous line data obtained from the line memory to reconstruct the present line data, when the second compressed data is output from the bit stream selector.

4. The display device of claim 1, wherein:

the second decompression unit includes:

decompressor outputting the first decompressed data generated by decompressing the compressed data received from the data compressor;

a summer summing up the first decompressed data output from the decompressor and the previous line data reconstructed by the source driver to output the second decompressed data; and a selector outputting any one of the first decompressed data output from the decompressor and the second decompressed data output from the summer to the data arranging unit.

5. The display device of claim 4, wherein;

the data arranging unit includes a plurality of shift register groups, the respective shift register group include a plurality of shift registers dependently connected to each other, and input terminals of shift resistors positioned at start stages of the respective shift resistor groups are connected to an output terminal of the selector, and output terminals of shift resistors positioned at final stages of the respective shift resistor groups are connected to an input terminal of the summer.

6. The display device of claim 5, wherein:

the plurality of shift register groups are sequentially shift-driven to output the previous line data reconstructed by the source driver to the input terminal of the summer in a point in time in which the first decompressed data is input to the input terminal of the summer.

7. The display device of claim 1, wherein:

the data compressor is a component of a timing controller.

8. The display device of claim 1, wherein:

the compression unit includes:

a first compressor to compress the present line data and output the first compressed data, a differential device calculating a differential between the present line data and the previous line data received from the line memory to output a differential data, and a second compressor compressing the differential data to output the second compressed data.

9. The display device of claim 8, wherein:

the first decompression unit includes:

a first decompressor decompressing the compressed data output from the hit stream selector to output a first decompressed data, a first summer summing the first decompressed data and the previous line data received from the line memory to output a sum data, a first selector selecting either the first decompressed data or the sum data depending on a selection result of the hit stream selector, and a delay delaying a transfer of the previous line data between the line memory and the first summer for a predetermined time.

10. The display device of claim 8, wherein:

the data output unit includes:

a data latch outputting line data output from the data arranging unit to a digital to analog converter, when the arrangement of the pixel data corresponding to one line is finished by the data arranging unit, the digital to analog converter converting the line data output from the data latch into analog signals appropriate for characteristics of the display panel, and an output buffer outputting the analog signals to the respective data lines of the display panel.

* * * * *